US005120187A

United States Patent [19]

Weber

[11] Patent Number: 5,120,187

[45] Date of Patent: Jun. 9, 1992

[54] POWER CONTROL ASSEMBLY FOR VEHICLE HAVING POWER TOOL ATTACHMENT

[76] Inventor: Murray S. Weber, 22 Wayne Ct., Redwood City, Calif. 94063

[21] Appl. No.: 624,856

[22] Filed: Dec. 10, 1990

[51] Int. Cl.[5] ..... E02F 3/28

[52] U.S. Cl. ..... 414/694; 180/324; 172/432

[58] Field of Search ..... 414/694, 909, 917, 680, 414/685, 697; 180/320, 321, 323, 324, 326, 332; 172/431, 432, 435; 37/103, 118 R

[56] References Cited

U.S. PATENT DOCUMENTS

| | | | |
|---|---|---|---|
| 1,155,916 | 10/1915 | Grout . | |
| 1,256,244 | 2/1918 | Mellin . | |
| 1,536,966 | 11/1923 | O'Leary . | |
| 1,546,389 | 10/1924 | Lane . | |
| 1,669,364 | 5/1928 | Winsor | 180/324 X |
| 2,546,231 | 11/1946 | Nehring et al. | 97/236 |
| 2,745,506 | 5/1956 | McCallum | 180/321 |
| 2,915,915 | 1/1957 | McKay | 74/480 |
| 3,143,353 | 2/1961 | Henningsen et al. | 275/3 |
| 3,456,525 | 3/1967 | Oldham | 74/544 |
| 3,648,540 | 3/1972 | King . | |
| 4,122,959 | 10/1978 | Stedman | 414/694 |
| 4,147,227 | 4/1979 | van der Lely | 180/324 X |

FOREIGN PATENT DOCUMENTS

| | | | |
|---|---|---|---|
| 138567 | 11/1979 | Fed. Rep. of Germany | 180/323 |
| 1059661 | 3/1954 | France | 180/320 |

*Primary Examiner*—Robert J. Spar
*Assistant Examiner*—Donald W. Underwood
*Attorney, Agent, or Firm*—Townsend and Townsend

[57] ABSTRACT

An improved power control device including a pair of remote levers having lower ends provided with pivot structure for pivotally attaching the remote levers to the support platform of a power tool attachment. A pair of rigid bars are pivotally coupled to the remote levers and extend rearwardly and are pivotally coupled to the power control levers of the vehicle. Thus, movement of the remote levers by a control operator at the power tool attachment causes corresponding movements of the power control levers of the vehicle so that the vehicle can be controlled by the operator on the power tool attachment. The pivot connections between the bars and the levers and between the remote levers and the platform of the power tool attachment can be quick-release fastener units.

9 Claims, 1 Drawing Sheet

POWER CONTROL ASSEMBLY FOR VEHICLE HAVING POWER TOOL ATTACHMENT

This invention relates to improvements in the control of the power used for operating a utility vehicle, such as a vehicle having a power tool attachment thereon and, more particularly, to an extension means for permitting remote control of the control levers of the drive motor of a utility vehicle.

BACKGROUND OF THE INVENTION

Utility vehicles of the type known as a Bobcat or a Case Uni-loader are generally used to carry and move a power tool, such as a backhoe or a power scoop. For instance, a backhoe, as is well known, can be used to dig a trench in the ground. A power scoop is used to scoop up dirt and other debris and to advance it to a specific location, such as to the bed of a dump truck.

The backhoe attachment, for instance, has a small platform which attaches to the vehicle in some suitable manner, such as by a pivotal linkage. The small platform supports a first seat and a number of power control levers which operate fluid power devices to manipulate articulated segments of the backhoe attachment.

To move the power hoe attachment over the ground from one location to another, the vehicle itself must be driven by operating a pair of power control levers. These two levers are adjacent to a second seat which is mounted between the ends of the vehicle and somewhat remote from the first seat of the backhoe attachment when the attachment is coupled to the vehicle.

It is sometimes necessary for the operator of the vehicle to drive the vehicle. While the operator is sitting on the first seat of the backhoe attachment. In this position, the operator faces forwardly. He must reach rearwardly of the first seat of the attachment, then grasp the upper ends of the power control levers of the vehicle and move the levers back and forth to thereby place the vehicle in forward or reverse operation. This exercise on the part of the power tool operator is strenuous and is unsafe in many instances, especially when moving over rocky terrain. This exercise is difficult to perform even by a vehicle operator in top physical condition.

Because of this problem, a need exists for improvements in controlling the vehicle from the first seat on the power tool attachment. The present invention provides a solution to the problem which involves a second set of levers on the power tool attachment which are coupled with the first set of levers on the vehicle so that the levers on the vehicle can be controlled remotely by the second set of levers.

SUMMARY OF THE INVENTION

The present invention provides an improved power control device which includes a pair of remote levers having lower ends provided with pivot structure for pivotally attaching the remote levers to the support platform the power tool attachment. A pair of rigid bars are pivotally coupled to the remote levers on the power tool attachment, and the bars extend rearwardly and are pivotally coupled to the power control levers of the vehicle. Thus, when the bars are so coupled to respective levers, movement of the remote levers at the power tool attachment causes corresponding movements of the power control levers of the vehicle so that the vehicle can be controlled by the operator of the power tool attachment when the operator is sitting on a seat adjacent to the remote levers and faces forwardly of the vehicle.

The pivot connections between the bars and the levers and between the remote levers and the platform of the power tool attachment can be quick-release fastener units so that the only separation needed to separate the vehicle from the power tool attachment is the separation of the bars from the power control levers of the vehicle, the bars and the levers of the power tool attachment remaining coupled to the attachment and being pivotally moved forwardly and into rest positions adjacent to the power tool attachment itself.

The primary object of the present invention is to provide an extension unit which can be used to connect two sets of control levers together when the levers are associated with a power vehicle and a power tool attachment coupled to the vehicle, whereby control of one set of levers can cause immediate control of the other set of levers to avoid unsafe operating condition while eliminating any strenuous activity required of the vehicle operator to control either set of levers.

Other objects of the present invention will become apparent as the following specification progresses, reference being had to the accompanying drawings for an illustration of the invention.

DETAILED DESCRIPTION OF THE EMBODIMENT

Figure 1:
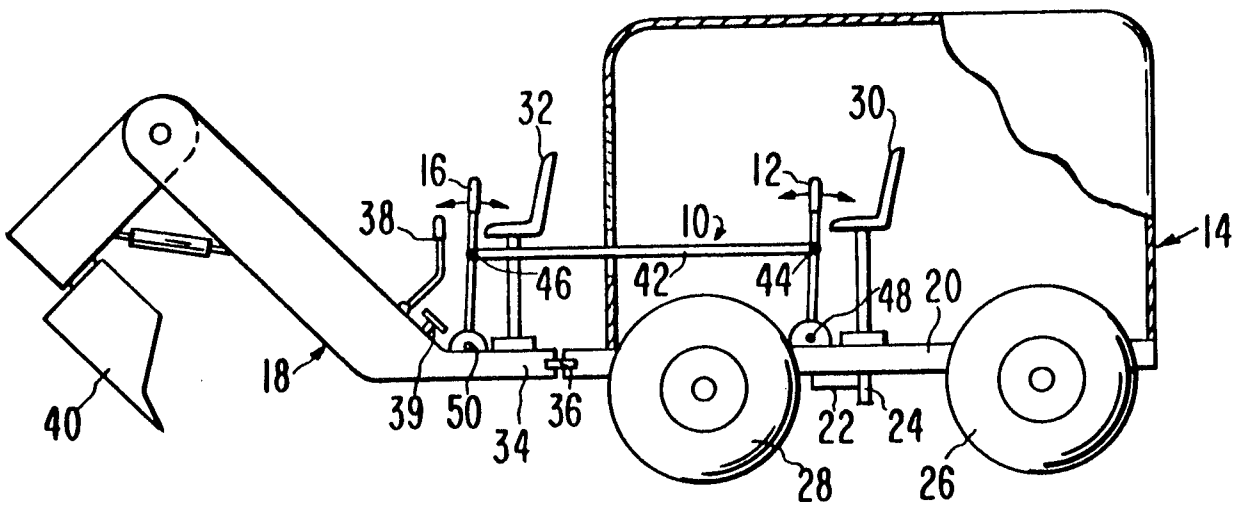
FIG. 1 is a side elevational view, partly in section, of a vehicle having means for attaching a backhoe to the front end thereof and showing the extension bar assembly of the present invention.

The present invention comprises an extension assembly 10 for connecting the power control levers 12 of a vehicle 14 with a pair of levers 16 mounted on a power tool attachment, such as a backhoe attachment 18 for pivotal movement with respect thereto. Vehicle 14 may be of any suitable construction but, for purposes of illustration, it is of the type known as a Case Uni-loader, made and sold by J.I. Case Company of Racine, Wisconsin. Another suitable vehicle is one known as Bobcat.

Vehicle 14 includes a platform 20 having a transmission 22 and a drive motor 24 thereon in any suitable location. The drive motor 24 is coupled in any suitable manner to a first set of drive wheels 26 which are rotatably mounted on axles coupled to platform 20. A second set of wheels 28 are secured to the platform 20 in spaced relationship to wheels 26.

Control levers 12 are at the front end of a seat 30 secured to platform 20 at a central location thereon. The levers 12 are hand operated normally by a person sitting in seat 30 so that the transmission 22 can be controlled to drive the vehicle 14 forwardly or in reverse or in a turning action. For instance, to drive the wheels forwardly, levers 12 are pivoted forwardly or to the left when viewing FIG. 1 by the operator of the vehicle seated on seat 30. To drive the vehicle in reverse, the levers 12 are pivoted to the right when viewing FIG. 1. To cause the vehicle to make turns, one lever 12 is pushed forwardly and the other lever 12 is pulled rearwardly. This causes rotational movement of vehicle 14 about a vertical axis which will cause the vehicle to turn right or left depending upon which lever 12 is moved forwardly and which lever 12 is moved in reverse.

Backhoe attachment 18 includes a seat 32 on a small platform segment 34 which is pivotally secured by pin means 36 to the forward end of platform 20. Thus, pin means 36 allows backhoe 18 to be articulated with respect to platform 20 or vehicle 14.

Backhoe attachment 18 has control levers 38 to raise and lower backhoe attachment 40. Thus, it is important that the person sitting on seat 32 be able to manipulate levers 38 to allow operation of the backhoe attachment as vehicle 14 is generally stationary.

Figure 2:
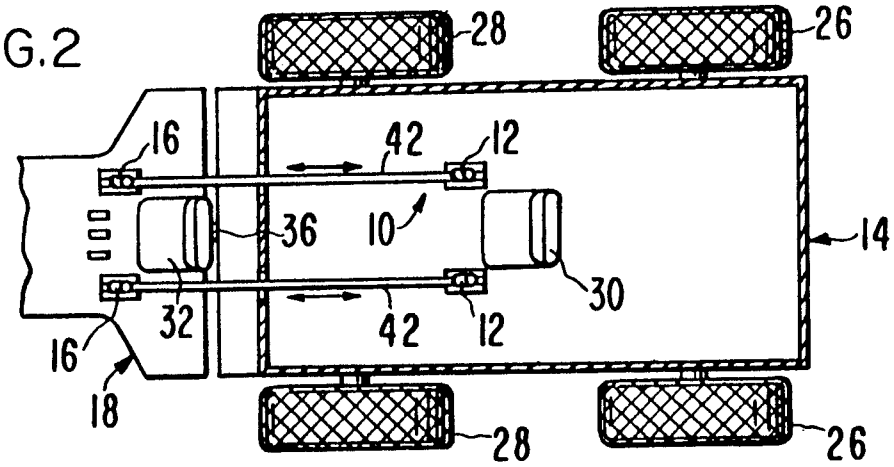
FIG. 2 is a top plan view of the vehicle of FIG. 1.

One of the objections of conventional equipment is the placing of the seat 32 too far forwardly of seat 30. Thus, the operator, while facing forwardly and seated on seat 32, must reach back from seat 32 to manipulate control levers 12 so as to control the operation of motor 24 and wheels 26 and 28 for making forward and reverse movements as well as for making turns. While the distance shown in FIG. 2 between seats 30 and 32 is somewhat exaggerated, the operator must stretch and strain to remain seated on seat 32, yet be sufficiently agile and limber to reach rearwardly and grasp control levers 12 for manipulating the same. This is an unsafe procedure since the operator on seat 32 is not in a good position to remain facing forwardly while stretching his arms rearwardly to grasp and manipulate levers 12. The purpose of the extension assembly 10 of the present invention is to eliminate this problem. This is achieved by providing a simple means for allowing an operator to sit in seat 32 and face forwardly of the vehicle 14. The vehicle operator then does not need to stretch his arms rearwardly while facing forwardly to move levers 12 and thereby control motor 24.

Assembly 10 includes a pair of generally horizontal bars 42, there being a bar 42 for each lever 12 and for each lever 16, respectively. The rear end of each bar 42 is coupled by a quick-release pivot means 44 to the respective lever 12 near the upper end of the lever. Similarly, quick-release pivot means 46 pivotally couples the front end of each bar 42 on the respective lever 16 near the upper end of the lever.

Pivot means 48 is provided for the lower end of each lever 12, respectively, for coupling the lever to the platform 20. Quick-release pivot means 50 is provided for each lever 16, respectively, for coupling the latter to platform segment 34 of backhoe attachment 18. Each lever 16 may be permanently or removably coupled by quick-release pivot means 50 to platform 34. Typically, in the stored condition of assembly 10, pivot means 44 is disconnected from levers 12 and bars 42 and levers 16 are pivoted forwardly and rest on backhoe attachment 18 in a standby condition. Bars 42 and levers 16 can also be in a rest position extending forwardly of the vehicle even though backhoe attachment 18 is removed from the vehicle 14.

In use, backhoe attachment 18 is removably attached by pivot means 36 to the front end of vehicle platform 20 in the manner shown in FIG. 1. Pivot means 50 is coupled to each of the respective levers 16, and bars 42 are coupled at the ends thereof to levers 12 and 16. The operator can then sit on seat 32 and operate vehicle 14 by manipulating levers 16 relative to backhoe attachment 18. Thus, when a lever 16 is moved forwardly, the corresponding lever 12 is also moved forwardly. Conversely, when a lever 16 is moved rearwardly, the corresponding lever 12 is moved rearwardly. Vehicle 14 can then be driven by the operator seated on seat 32. Operation of the vehicle does not require that the hands of the operator be stretched rearwardly to grasp and manipulate levers 12 as has been required in the past. Thus, the operator need not move from seat 12 to operate motor 24 while at the same time being capable of operating levers 38 for manipulating the backhoe attachment 18.

I claim:

1. In combination: an assembly including a vehicle and a back hoe attachment, said vehicle having a drive motor and a first upright lever pivotally mounted on the vehicle for controlling the drive motor, said vehicle having a first end, said back hoe attachment having a second upright lever pivotally mounted thereon and spaced from the first lever, a bar pivotally connected at the ends thereof to respective levers for coupling the levers together at the upper ends of the levers, said bar permitting the first lever to move relative to the vehicle in response to the movement of the second lever.

2. The combination as set forth in claim 1, wherein is included a seat for each of the first and second levers, respectively, the seats being on the assembly adjacent to respective levers.

3. The combination as set forth in claim 1, wherein is included a seat for each of said first and second levers, respectively, the seats being rearwardly of the respective levers and mounted on the vehicle and the attachment, respectively.

4. In combination:

a vehicle having a support, ground engaging wheels on the support, a pair of spaced, generally upright first levers pivotally mounted on the support and movable fore and aft relative to the support;

a back hoe attachment having means for coupling the same to the vehicle near one end thereof, said back hoe attachment having a pair of generally upright second levers, and pivot means coupling each second lever, respectively, to the back hoe attachment; and a pair of bars, each bar being pivotally coupled at the ends thereof to respective first and second levers near the upper ends of the levers, whereby fore and aft movements of the second levers will cause fore and aft movements of the first levers.

5. The combination as set forth in claim 4, wherein is included a first seat near each pair of first levers and a second seat near each pair of second levers, respectively.

6. The combination as set forth in claim 4, wherein said backhoe attachment has means for attaching the rear end of the backhoe attachment to the front end of the vehicle.

7. The combination as set forth in claim 4, wherein at least one end of each bar, respectively, has quick-release fastening means to permit separation of the bar from the corresponding lever.

8. The combination as set forth in claim 5, wherein the vehicle has a first platform and the back hoe attachment has a second platform, the seats being on respective platforms.

9. The combination as set forth in claim 8, wherein the first levers are on the first platform and the second levers are on the second platform.

* * * * *